United States Patent [19]

Terauchi

[11] Patent Number: 4,460,321

[45] Date of Patent: Jul. 17, 1984

[54] AXIAL CLEARANCE ADJUSTMENT MECHANISM FOR SCROLL TYPE FLUID DISPLACEMENT APPARATUS

[75] Inventor: Kiyoshi Terauchi, Isesaki, Japan

[73] Assignee: Sanden Corporation, Gunma, Japan

[21] Appl. No.: 356,373

[22] Filed: Mar. 9, 1982

[30] Foreign Application Priority Data

Mar. 10, 1981 [JP] Japan ..... 56-33091

[51] Int. Cl.[3] ..... F01C 1/02; F01C 19/00; F01C 21/10

[52] U.S. Cl. ..... 418/55; 418/107; 418/149

[58] Field of Search ..... 418/55, 57, 107, 149

[56] References Cited

U.S. PATENT DOCUMENTS 3,040,664 6/1962 Hartley ..... 418/149
3,359,913 12/1967 Halsey ..... 418/149
3,994,635 11/1976 McCullough ..... 418/57

FOREIGN PATENT DOCUMENTS 55-64179 5/1980 Japan ..... 418/57

*Primary Examiner*—John J. Vrablik
*Attorney, Agent, or Firm*—Banner, Birch, McKie & Beckett

[57] ABSTRACT

A scroll type fluid displacement apparatus is disclosed having an adjustment mechanism for adjusting the axial clearance between the spiral elements and end plates of the fixed and orbiting scrolls. The apparatus includes a housing having a front end plate and a cup shaped casing attached thereto; the cup shaped casing has a fluid inlet port and a fluid outlet port. A fixed scroll, which includes a first end plate and a first spiral element, is fixedly disposed within the interior of the cup shaped casing. A large threaded opening is formed through an end plate of the cup shaped casing. An adjusting screw is screwed in the threaded opening to abut against the end surface of the fixed scroll. After adjusting the axial clearance between the fixed and orbiting scrolls by adjusting the position of the adjusting screw, a plurality of bolts fasten the fixed scroll to the cup shaped casing to prevent further axial movement. Therefore, the adjustment of the axial clearance between the scrolls is easily obtained by adjustment of the adjusting screw of the present invention.

11 Claims, 4 Drawing Figures

AXIAL CLEARANCE ADJUSTMENT MECHANISM FOR SCROLL TYPE FLUID DISPLACEMENT APPARATUS

BACKGROUND OF THE INVENTION

This invention relates to a fluid displacement apparatus, and more particularly, to an axial clearance adjustment mechanism for a scroll type fluid displacement apparatus.

Scroll type fluid displacement apparatus are well known in the prior art. For example, U.S. Pat. No. 801,182 (Creux) discloses a device including two scroll members each having a circular end plate and a spiroidal or involute spiral element. These scroll members are maintained angularly and radially offset so that both spiral elements interfit to make a plurality of the contacts between their spiral curved surfaces to thereby seal off and define at least one pair of fluid pockets. The relative orbital motion of the two scroll members shifts the line contacts along the spiral curved surfaces and, therefore, the fluid pockets change in volume. Since the volume of the fluid pockets increases or decreases dependent on the direction of the orbital motion, the scroll type fluid displacement apparatus is applicable to compress, expand or pump fluids.

In comparison with conventional compressors of the piston type, the scroll type compressor has certain advantages, such as fewer parts and continuous compression of the fluid. However, one of the problems encountered in prior art scroll type compressors has been ineffective sealing of the fluid pockets. Axial and radial sealing of the fluid pockets must be maintained in a scroll type compressor in order to achieve efficient operation. The fluid pockets in a scroll type compressor are defined by both the line contacts between the interfitting spiral elements and the axial contacts between the axial end surfaces of the spiral elements and the inner surfaces of the end plates. Thus, the clearance between the scroll members, particularly the axial clearance between the axial end surfaces of the spiral elements and the inner surfaces of the end plates of the scroll members, exerts an influence upon the volume efficiency or energy efficiency of the scroll type compressor.

One prior art solution to the axial sealing problem is described in U.S. Pat. No. 3,874,827 (Young). The Young patent discloses a non-rotatable fixed scroll member supported within the housing of the scroll apparatus in an axially floating condition. A high pressure fluid is introduced behind the fixed scroll member to establish sufficient axial sealing. However, because the fixed scroll member in the Young patent is supported in a axially floating condition, the fixed scroll member may wobble due to the eccentric orbital motion of the orbiting scroll member. Therefore, axial and radial sealing of the fluid pockets, and the resultant fluid compression, tend to be imperfectly performed.

Generally, the fixed scroll member of prior art scroll type apparatus is fixedly disposed within the housing. Then, as shown by way of example in co-pending application Ser. No. 260,826, filed on May 5, 1981, axial clearance between the axial end surface of the spiral element of one scroll member and the inner surface of the end plate of the other scroll member is adjusted by placing a plurality of shims between the casing and the front end plate of the fixed scroll member. However, since there is a limit to the thickness of the shims, sufficient adjustment of the axial clearance is difficult to achieve. In the event the axial clearance is too great, the gap between the axial end surface of the spiral element of one scroll member and the inner surface of the end plate of the other scroll member is sealed by a sealing element placed between these surfaces.

Furthermore, in the above prior art scroll type apparatus, one of the scroll members generally is formed of hard material and the other scroll member is formed of lighter slightly softer material in order to reduce weight. This difference in hardness results in increased wear of the end plate of the softer scroll member due to constant contact by the axial sealing element placed between this end plate and the spiral element of the hard scroll member. Therefore, the inner surface of the softer scroll member normally must be provided with a bottom plate for preventing wear of the end plate.

SUMMARY OF THE INVENTION

It is a primary object of this invention to provide an improved scroll type fluid displacement apparatus in which the axial clearance between the scroll members can be properly and sufficiently adjusted to accommodate changes in operating conditions and to minimize wear of the scroll members.

It is another object of this invention to provide a scroll type fluid displacement apparatus in which the end plate surfaces of the scroll members are less susceptible to wear.

It is still another object of this invention to provide a scroll type fluid displacement apparatus which accomplishes the above objects while being simple in construction and easy to manufacture.

A scroll type fluid displacement apparatus according to this invention includes a housing comprising a front end plate and a cup shaped casing having a fluid inlet port and a fluid outlet port. A fixed scroll is fixedly disposed relative to the housing and has a first end plate from which a first wrap extends into the interior of the housing. An orbiting scroll has a second end plate from which a second wrap extends. The first and second wraps interfit at an angular and radial offset to make a plurality of line contacts to define at least one pair of sealed off fluid pockets. A driving mechanism, which includes a rotatable drive shaft, effects orbital motion of the orbiting scroll upon rotation of the drive shaft. Rotation of the orbiting scroll is prevented by a rotation preventing device so that the fluid pockets between the wraps change volume during the orbital motion of the orbiting scroll.

In particular, the present invention is directed to an adjustment mechanism for adjusting the axial position of the fixed scroll relative to the orbiting scroll to provide proper axial clearance. The fixed scroll is supported by the cup shaped casing of the housing. A large threaded opening is formed through an end plate of the cup shaped casing. An adjusting screw, which is screwed in the threaded portion of the end plate, abuts the end surface of the fixed scroll to push against the fixed scroll in the axial direction. After adjustment of the position of the fixed scroll by use of the adjusting screw, the fixed scroll is fixed to the cup shaped casing by a plurality of bolts. Therefore, the adjustmenet of the axial clearance between the axial end surface of the spiral elements and the inner surface of the end plates is easily obtained by adjustment of the position of the adjusting screw.

Further objects, features and other aspects of this invention will be understood from the following detailed description of the preferred embodiment of this invention referring to the annexed drawings.

DETAILED DESCRIPTION OF THE PREFERRED EMBODIMENT

Figure 1:
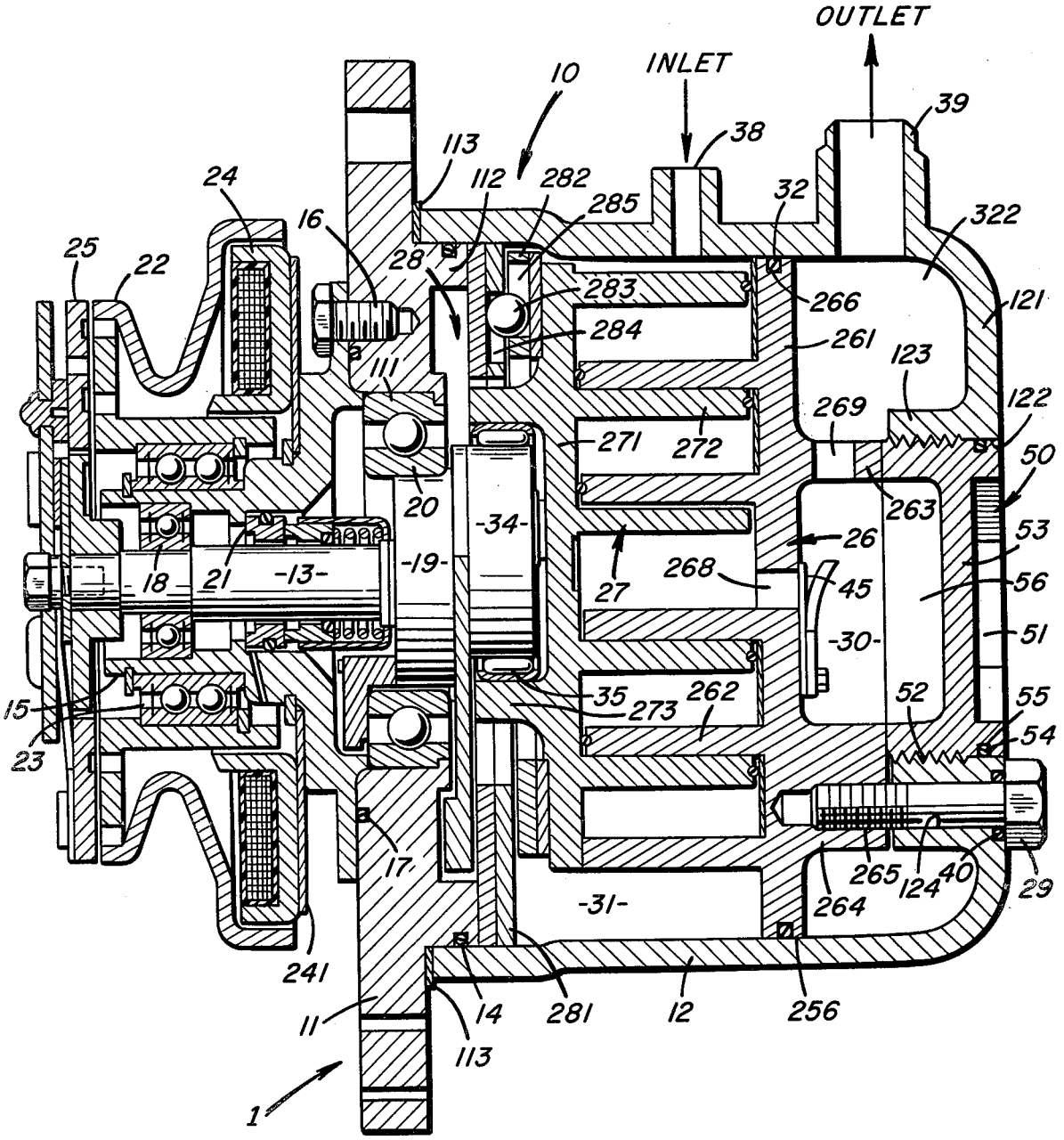
FIG. 1 is a vertical sectional view of a compressor according to one embodiment of this invention.

Referring to FIG. 1, a fluid displacement apparatus in accordance with the present invention is shown which consists of a scroll type refrigerant compressor 1. Compressor 1 includes a compressor housing 10 having a front end plate 11 and a cup shaped casing 12 fastened to an end surface of front end plate 11. An opening 111 is formed in the center of front end plate 11 for supporting drive shaft 13. An annular projection 112, concentric with opening 111, is formed on the rear end surface of front end plate 11 facing cup shaped casing 12. An outer peripheral surface of annular projection 112 bites into an inner wall of the opening of cup shaped casing 12. Cup shaped casing 12 is fixed on the rear end surface of front end plate 11 by a fastening device, such as bolts and nuts, so that the opening in cup shaped casing 12 is covered by front end plate 11. An O-ring 14 is placed between the outer peripheral surface of annular projection 112 and the inner wall of the opening of cup shaped casing 12 to seal the mating surface of front end plate 11 and cup shaped casing 12. Front end plate 11 has an annular sleeve 15 projecting from the front end surface thereof; this sleeve 15 surrounds drive shaft 13 to define a shaft seal cavity. As shown in FIG. 1, sleeve 15 is attached to the front end surface of front end plate 11 by screws 16, one of which is shown in FIG. 1. An O-ring 17 is placed between the front end surface of front end plate 11 and an end surface of sleeve 15 to seal the mating surface of front end plate 11 and sleeve 15. Alternatively, sleeve 15 may be formed integral with front end plate 11.

Drive shaft 13 is rotatably supported by sleeve 15 through a bearing 18 disposed within the front end of sleeve 15. Drive shaft 13 has a disk shaped rotor 19 at its inner end; disk shaped rotor 19 is rotatably supported by front end plate 11 through a bearing 20 disposed within the opening 111 of front end plate 11. A shaft seal assembly 21 is assembled on drive shaft 13 within the shaft seal cavity of sleeve 15.

A pulley 22 is rotatably supported by a bearing 23 on the outer surface of sleeve 15. An electromagnetic annular coil 24 is mounted on the outer surface of sleeve 15 by a support plate 241, which is received in an annular cavity of pulley 22. An armature plate 25 is elastically supported on the outer end of drive shaft 13 which extends from sleeve 15. A magnetic clutch is formed by pulley 22, magnetic coil 24 and armature plate 25. Thus, drive shaft 13 is driven by an external power source, for example, an engine of a vehicle, through a rotation transmitting device, such as the above described magnetic clutch.

A number of elements are located within the inner chamber of cup shaped casing 12 including a fixed scroll 26, an orbiting scroll 27 a driving mechanism for orbiting scroll 27 and a rotation preventing/thrust bearing device 28 for orbiting scroll 27. The inner chamber of cup shaped casing 12 is formed between the inner wall of cup shaped casing 12 and front end plate 11.

Fixed scroll 26 includes a circular end plate 261, a wrap or spiral element 262 affixed to or extending from one end surface of circular end plate 261, and an annular wall 263. The annular wall 263 axially projects from the other end surface of circular end plate 261 on the side opposite spiral elements 262. Annular wall 263 has a plurality of equally spaced tubular portions 264 on which screw holes 265 are formed. An axial end surface of each tubular portion 264 abuts an inner end surface of end plate 121 of cup shaped casing 12. Fixed scroll 26 is fixed to end plate 121 of cup shaped casing 12 by bolts 29, one of which is shown in FIG. 1. These screws screw into screw holes 265 of tubular portions 264 from the outside of end plate 121. Hence, fixed scroll 26 is fixedly disposed within cup shaped casing 12. Circular end plate 261 of fixed scroll 21 partitions the inner chamber of cup shaped casing 12 into a rear chamber 30 having side walls 263, and a front chamber 31, in which spiral element 262 of fixed scroll 26 is located. A sealing element 32 is disposed within circumferential groove 266 of circular end plate 261 for sealing the outer peripheral surface of circular plate 261 and the inner wall of cup shaped casing 12. A hole or discharge port 268 is formed through circular end plate 261 at a position near the center of spiral element 262; discharge port 268 connects the fluid pocket at the center of spiral element 262 and rear chamber 30. Furthermore, at least one connecting hole or fluid port 269 is formed through side wall 263 to connect rear chamber 30 to outer chamber 322, which is in turn connected to outlet port 39.

Orbiting scroll 27, which is disposed in front chamber 31, includes a circular end plate 271 and a wrap or spiral element 272 affixed to or extending from one end surface of circular end plate 271. The spiral elements 262 and 272 interfit at an angular offset of 180° and a predetermined radial offset. The spiral elements define at least a pair of fluid pockets between their interfitting surfaces. Orbiting scroll 27 is connected to the driving mechanism and the rotation preventing/thrust bearing device. The driving mechanism and the rotation preventing/thrust bearing device effect oribital motion of orbiting scroll 27 by rotation of drive shaft 13 to thereby compress fluid passing through compressor 1.

Figure 2:
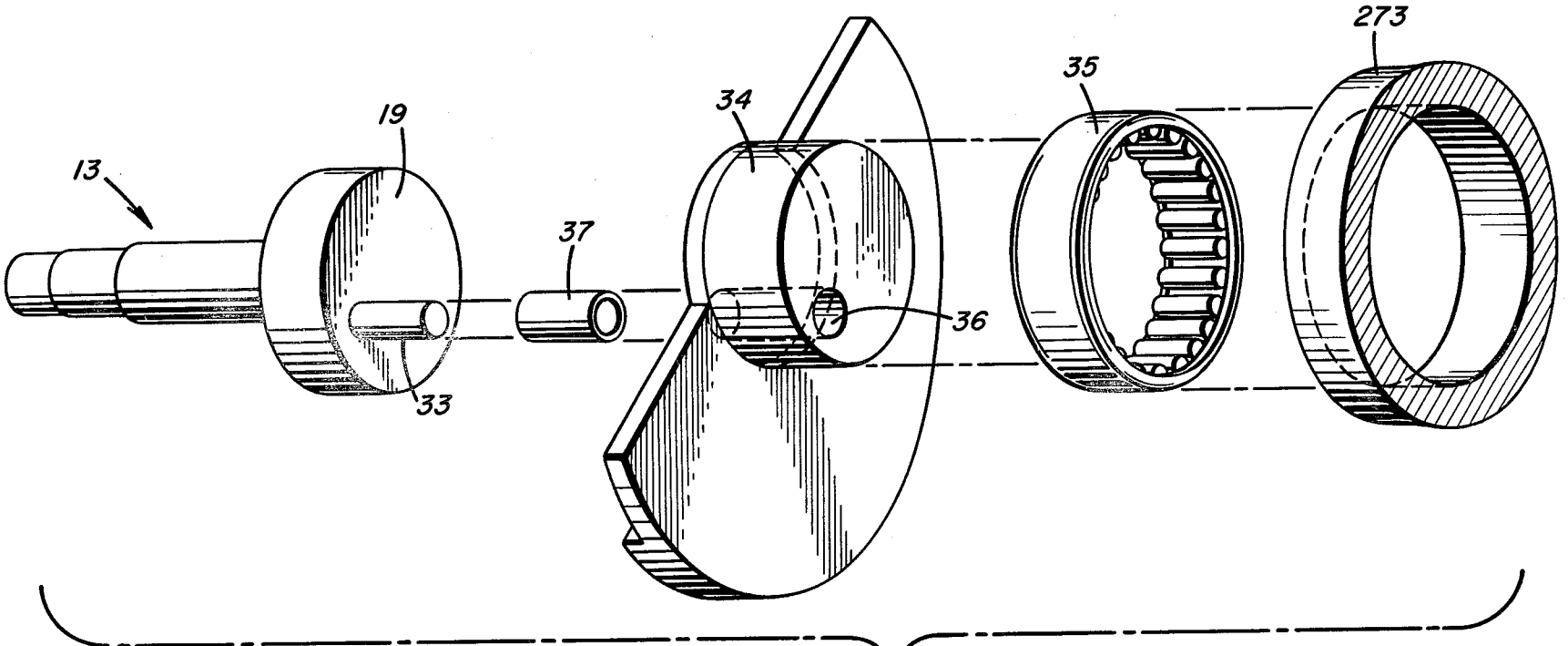
FIG. 2 is an exploded perspective view of the driving mechanism of the compressor of FIG. 1.
Figure 3:
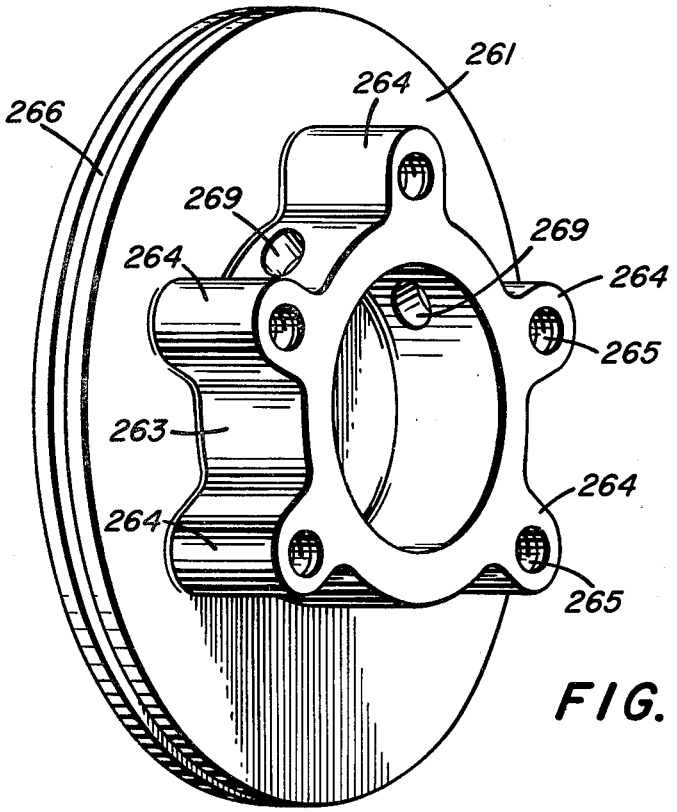
FIG. 3 is a perspective view of the fixed scroll member of the compressor of FIG. 1.

Referring to FIGS. 1 and 2, the driving mechanism of orbiting scroll 27 will now be described. As described above, drive shaft 13, which is rotatably supported by sleeve 15 through bearing 18, has a disk shaped rotor 19 at its inner end. Disk shaped rotor 19 is rotatably supported by front end plate 11 through bearing 20. A crank pin or drive pin 33 projects axially from an axial end surface of disk shaped rotor 19 and is radially offset from the center of drive shaft 13. Circular end plate 271 of orbiting scroll 27 is provided with a tubular boss 273 axially projecting from the surface opposite to the end surface from which spiral element 272 extends. A discoid or short axial bushing 34 fits into boss 273, and is rotatably supported thereby by a bearing, such as needle bearing 35. An eccentric hole 36 is formed on bushing 34; the eccentric hole is radially offset from the center of bushing 34. Drive pin 33, which is surrounded by bearing 37, fits into eccentric hole 36. Therefore, bushing 34 is driven by revolution of drive pin 33 to thereby rotate within bearing 35.

Now, the rotation of orbiting scroll 27 is prevented by the rotation preventing/thrust bearing device 28, which is disposed between the inner wall of the housing and circular end plate 271 of orbiting scroll 27. As a result, the orbiting scroll 27 orbits while maintaining its angular orientation relative to fixed scroll 26.

The rotation preventing/thrust bearing device 28 includes a fixed ring 281, which is fastened against the axial end surface of annular projection 112, an orbit ring 282, which is fastened against the end surface of circular end plate 271 by a fastening device, and a bearing element, such as spherical balls 283. Rings 281 and 282 have a plurality of indentations 284, 285 and one of the spherical balls 283 is retained between each of these indentations 284, 285. Therefore, the rotation of orbiting scroll 27 is prevented by balls 283, which interact with the edges of indentations 284, 285 to prevent rotation. Also, these balls 283 carry the axial thrust load from orbiting scroll 27.

As the orbiting scroll 27 orbits, the line contacts between spiral elements 262 and 272 shift toward the center of the spiral elements along the surfaces of the spiral elements. The fluid pockets defined by the line contacts between spiral elements 262 and 272 move toward the center with a consequent reduction of volume, to thereby compress the fluid in the fluid pockets. Therefore, fluid or refrigerant gas introduced into front chamber 31 from an external fluid circuit through an inlet port 38 mounted on the outside of cup shaped casing 12 is taken into the fluid pockets formed at the outer portions of spiral elements 262 and 272. As orbiting scroll 27 orbits, the fluid in the fluid pockets is compressed as the pockets move toward the center of the spiral elements. Finally, the compressed fluid is discharged into rear chamber 30 through hole 268, and therefrom, the fluid 15 is discharged to the external fluid circuit through outlet port 39 formed on cup shaped casing 12.

In the above described construction, end plate 121 has a central opening 122 and an annular projection 123 projecting axially inward along the inner surface of opening 122. The inner diameter of opening 122 is slightly smaller than the outer diameter of wall 263 of fixed scroll 26. Threads are formed on the inner peripheral surface of annular projection 123 and part of opening 122. Furthermore, annular projection 123 has a plurality of equally spaced tubular portions, which face the tubular portions 264 of wall 263. Holes 124 are formed in each of the tubular portions of annular projection 123 for receiving screws or bolts 29 which are screwed into the tubular portions 264 of wall 263.

Figure 4:
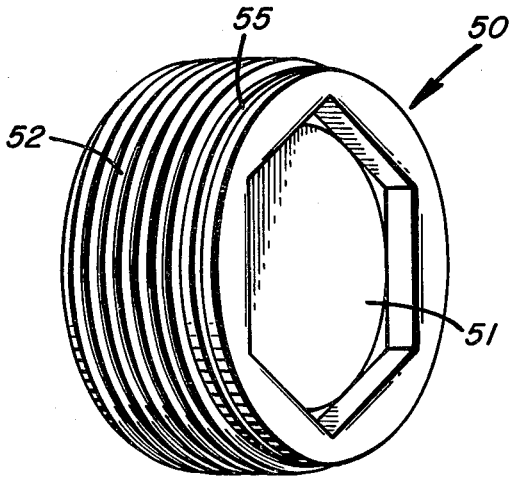
FIG. 4 is a perspective view of the adjusting screw which abuts the fixed scroll member of the compressor of FIG. 1.

An adjusting screw 50 is screwed into the threaded portion of annular projection 123. Adjusting screw 50 has threads 52 on its outer peripheral surface and an indentation 51 at its outer axial end surface for receiving a screwing tool, as shown in FIG. 4. An inner axial end surface of adjusting screw 50 fits against the axial end surface of wall 263. Adjusting screw 50 has an inner indentation 56 at its center for enlarging rear chamber 30. An O-ring 54 is placed in circumferential groove 55 formed on the outer surface of adjusting screw 50 to seal the inner surface of opening 122 and the outer surface of adjusting screw 50. Therefore, fluid leakage along the outer surface of adjusting screw 50 is prevented. Furthermore, fluid leakage along holes 124 in cup shaped casing 12 is prevented by O-rings 40 disposed between the outer surface of end plate 121 and each bolt 29.

The axial clearance between orbiting scroll 27 and fixed scroll 26 can be adjusted as described hereinafter. Cup shaped casing 12, which supports fixed scroll 26, first is covered by front end plate 11. The driving mechanism, rotation preventing/thrust bearing device 28 and orbiting scroll 27 then are assembled on front end plate 11. Fixed scroll 26 is then disposed in cup shaped casing 12 at an angular offset of 180° relative to orbiting scroll 27 and so that screw holes 265 of wall 263 are aligned with penetration holes 124 of end plate 121. After cup shaped casing 12 is fixed on the rear end surface of front end plate 11, adjusting screw 50 is screwed into position within annular projection 123 and is tightened at a desired torque until the fixed and orbiting scrolls make axial contact. Next, adjusting screw 50 is turned back a desired turn back angle ($\alpha$) for obtaining proper axial clearance between the fixed and orbiting scrolls to avoid excessive friction between the scrolls. After adjusting the axial clearance, screws or bolts 29 are screwed into holes 265 to tightly fix the fixed scroll 26 to end plate 121.

The value of axial clearance C is given by $C=(t)(\alpha)/360°$, where t is screw pitch and ($\alpha$) is the turn back angle of adjusting screw 50. Therefore, the desired axial clearance can be easily obtained by the proper adjustment of turn back angle ($\alpha$) of adjusting screw 50.

In accordance with the above construction, an accurate desired axial clearance between the axial end surfaces of both spiral elements can be obtained to thereby improve the seal efficiency of the sealed off fluid pockets defined by the fixed and orbiting scrolls. This can be accomplished without the use of a tip seal element disposed between the axial end surfaces of the spiral elements and the circular end plates of the scrolls. The axial clearance adjustment mechanism of the present invention can be used to improve volume efficiency and energy efficiency of the scroll type compressor 1. Furthermore, excessive friction between the axial end surfaces of the spiral elements and the circular end plates of the scrolls is avoided to minimize wear. Finally, the bottom plate normally disposed on the end surface of the circular end plate facing the spiral element to prevent wear of the circular end plate can be omitted.

This invention has been described in detail in connection with preferred embodiments, but these embodiments are merely for example only and this invention is not restricted thereto. It will be easily understood by those skilled in the art that other variations and modifications can be easily made within the scope of this invention, as defined by the appended claims.

I claim:

1. In a scroll type fluid displacement apparatus including a housing having a front end plate and a cup shaped casing, a fixed scroll fixedly disposed relative to said housing and having a first end plate from which a first wrap extends into said housing, an orbiting scroll having a second end plate from which a second wrap extends, said first and second wraps interfitting at an angular and radial offset to make a plurality of line contacts to define at least one pair of sealed off fluid pockets, a driving mechanism to effect orbital motion of said orbiting scroll, and rotation preventing means for preventing rotation of said orbiting scroll during orbital motion so that the fluid pockets change volume, the improvement comprising:

an opening having a threaded portion formed in an end plate of said cup shaped casing;

an adjusting screw screwed into said threaded portion of said opening to adjust the axial clearance between said fixed and orbiting scrolls, said adjusting screw having an axial end surface abutting against an axial end surface of said first end plate of said fixed scroll; and a plurality of fastening devices fastening said fixed scroll to said end plate of said cup shaped casing to maintain the axial clearance between the axial end surfaces of each of said wraps and the inner surfaces of each of said end plates after said adjusting screw is screwed into said opening.

2. The improvement as claimed in claim 1 wherein a sealing element is disposed between said opening and the outer surface of said adjusting screw.

3. The improvement as claimed in claim 2 wherein a sealing element is disposed between said end plate of said cup shaped casing and each of said fastening devices.

4. The improvement as claimed in claim 1 wherein said first end plate of said fixed scroll has a plurality of internally threaded bosses on the opposite side thereof from which said first wrap extends, the axial end surface of said adjusting screw abutting against the axial end surface of said threaded bosses, said end plate of said cup shaped casing having a plurality of screw holes aligned with said threaded bosses to receive said fastening devices, each of said fastening devices being screwed into said threaded bosses through said screw holes.

5. The improvement as claimed in claim 4 wherein said end plate of said cup shaped casing has an annular projection forming said threaded portion of said opening.

6. The improvement as claimed in claim 1 wherein said end plate of said cup shaped casing has an annular projection projecting axially along said opening adjacent said first end plate of said fixed scroll, an inner surface of said annular projection having said threaded portion of said opening formed thereon.

7. The improvement as claimed in claims 4, 5 or 6 wherein said adjusting screw has an indentation on its inner end surface to form a cavity between said adjusting screw and said first end plate of said fixed scroll.

8. A scroll type fluid displacement apparatus comprising:

a housing including a front end plate and a cup shaped casing;

a fixed scroll fixedly disposed relative to said housing and having a first end plate from which a first wrap extends into said housing;

an orbiting scroll having a second end plate from which a second wrap extends, said first and second wraps interfitting at an angular and radial offset to make a plurality of line contacts to define at least one pair of sealed off fluid pockets;

a driving mechanism to effect orbital motion of said orbiting scroll;

rotation preventing means connected to said orbiting scroll for preventing rotation of said orbiting scroll during orbital motion and maintaining the angular relationship between said fixed and orbiting scrolls so that the fluid pockets change volume during orbital motion of said orbiting scroll;

an opening having a threaded portion formed in an end plate of said cup shaped casing;

an adjusting screw screwed into said threaded portion of said opening to adjust the axial clearance between said fixed and orbiting scrolls, said adjusting screw having an axial end surface abutting against the axial end surface of said first end plate of said fixed scroll; and a pluraltiy of fastening devices fastening said first end plate of said fixed scroll to said end plate of said cup shaped casing to maintain axial clearance between the axial end surface of each of said wraps and the inner surface of each of said end plates of said scrolls after said adjusting screw is screwed into said opening.

9. The improvement as claimed in claim 8 wherein said first end plate of said fixed scroll has an annular projection axially projecting from the opposite side thereof from which said first wrap extends and a plurality of screw holes formed on an axial end surface of said annular projection to receive said fastening devices, the axial end surface of said adjusting screw abutting against the axial end surface of said annular projection.

10. The improvement as claimed in claim 9 wherein said end plate of said cup shaped casing has an annular projection extending axially inward to form said opening, an inner surface of said annular projection of said end plate forming said threaded portion.

11. The improvement as claimed in claims 8, 9 or 10 wherein a first sealing element is disposed between said opening and the outer surface of said adjusting screw and a plurality of second sealing elements are disposed between said end plate of said cup shaped casing and each of said plurality of fastening devices.

* * * * *